United States Patent [19]

Manuel, deceased et al.

[11] 3,983,725

[45] *Oct. 5, 1976

[54] PADLOCK CASE

[76] Inventors: Larry N. Manuel, deceased, late of Lakewood, Calif; by Ruby Joy Manuel, executrix, 10318 Oak Gate, Bellflower, Calif. 90706

[ * ] Notice: The portion of the term of this patent subsequent to Nov. 19, 1991, has been disclaimed.

[22] Filed: Nov. 11, 1974

[21] Appl. No.: 522,700

Related U.S. Application Data

[63] Continuation of Ser. No. 334,491, Feb. 21, 1973, Pat. No. 3,848,440.

[52] U.S. Cl. ..... 70/55

[51] Int. Cl.[2] ..... E05B 67/38

[58] Field of Search ..... 70/52, 54–56, 70/455, 417; 206/521; 249/121, 92, 97; 150/.5, 52 R

[56] References Cited

UNITED STATES PATENTS 1,662,612 3/1928 Junkune ..... 70/55 X 3,848,440 11/1974 Manuel ..... 70/55

FOREIGN PATENTS OR APPLICATIONS 395,613 5/1924 Germany ..... 70/55

*Primary Examiner*—Robert L. Wolfe

*Attorney, Agent, or Firm*—Robert J. Schaap

[57] ABSTRACT

A padlock case adapted to contain the body portion of a padlock. The case includes a container and a cover that mates with the container to surround the padlock body of a padlock. Bevelled holes in the cover tightly receive the legs of the shackle of the padlock so that water cannot seep into the case via the openings provided by the cover holes. Container lips on flexible container walls act to hold the padlock body within the container. A container flange fits into a cover flange to form a seal between the cover and the container. The above and other features of the case increase its utility. The case is well suited for outdoor use on a padlock body and is especially suited to keep mud, water, or other harmful elements away from the body portion of a padlock.

30 Claims, 7 Drawing Figures

PADLOCK CASE

RELATED APPLICATION

This application is a continuation of application Ser. No. 334,491, filed Feb. 21, 1973, for Padlock Case, now U.S. Pat. No. 3,848,440.

FIELD OF THE INVENTION

This invention relates to cases adapted to contain the body portions of padlocks in order to protect the padlock body portions from being ruined by direct exposure to mud, sand, water, dirt, rain like deleterious atmospheric conditions.

BACKGROUND OF THE INVENTION

Padlocks are used outdoors on vehicles, boats, and elsewhere to lock up articles such as vehicle spare tire, bicycles and other articles. Any padlock that is left outdoors can be ruined in a short time by mud, sand, dirt, water, rain or moisture. Mud can clog up the key slot of a key operated padlock. Water or moisture can get into the body portion of the padlock causing the parts of the lock mechanism to rust. The padlock can become tarnished and therefore unsightly. A rusty padlock can "freeze up" so that it cannot be unlocked. Many of the padlocks that are currently sold are brought as replacements for padlocks that have been rendered useless due to having been directly exposed to outdoor conditions in which they have been covered with mud, placed in water, or otherwise subjected to harmful elements.

It is the main object of the present invention to provide a case that is adapted to contain the body portion of a padlock that is to be used outdoors. The case serves to keep the padlock in good working condition when it is subject during normal use to mud, water, moisture, or the like.

The case provided by the present invention can be made in various forms and can include various features. The particular padlock described hereinafter is comprised of a container and a cover that removably mates with the container. The cover has two bevelled holes adapted to receive respective shackle legs of the padlock. A padlock body portion can be disposed within the container with the legs of the padlock's shackle extending through the holes in the cover to the outside of the case. The cover holes are sized to form a close fit between the shackle legs and the surrounding portions of the cover. The described padlock case includes several features that add to the utility of the case. One feature is flexible container walls having lips that act to hold the container onto the padlock body portion. Another feature is a container flange that fits into a flange on the case cover to form a seal between the cover and the container.

The above and other objects of the present invention and advantages and features of the invention will be made clear upon review of the following discussion of an embodiment of the present invention taken in conjunction with the accompanying drawings.

DESCRIPTION OF THE PREFERRED EMBODIMENT

Figure 1:
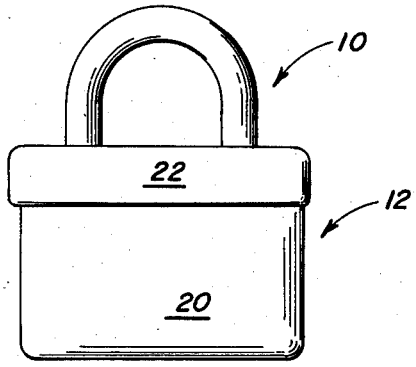
FIG. 1 is a front elevational view of a padlock case comprised of a container and a cover and which encloses a body portion of the padlock with the shackle shown as extending through the cover.
Figure 2:
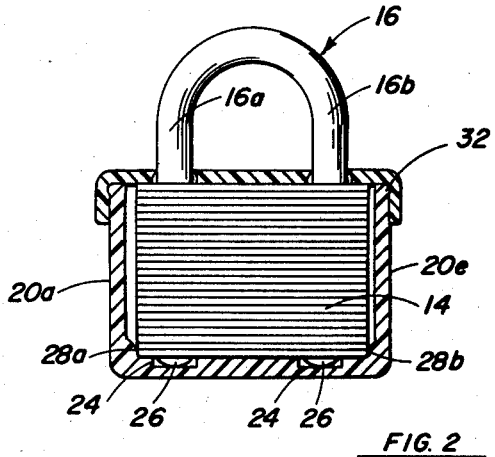
FIG. 2 is a vertical sectional view similar to the view of FIG. 1 with the padlock case being shown in cross section in this instance.
Figure 3:
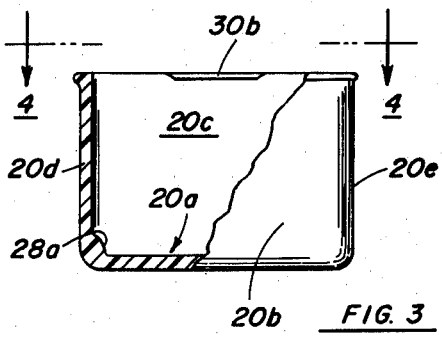
FIG. 3 is an elevational view of a padlock case container shown with a portion of its front wall cut away and in section.
Figure 4:
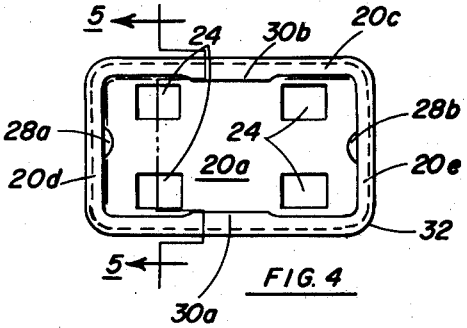
FIG. 4 is a top plan view of a case container taken along line 4—4 of FIG. 3.
Figure 6:
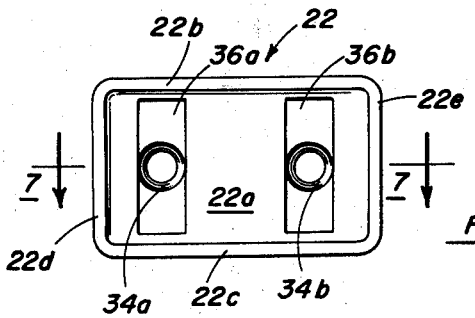
FIG. 6 is a bottom plan view of the bottom side of a case cover also shown in FIGS. 1 and 2.
Figure 5:
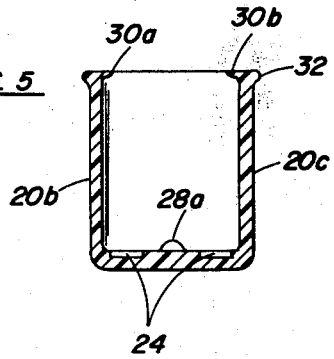
FIG. 5 is a transverse sectional view taken along line 5—5 of FIG. 4.

FIGS. 1 and 2 show a conventional padlock 10 in combination with a case 12 of the present invention. The padlock 10 includes a padlock body portion and a shackle. The padlock body portion, or padlock body, is labelled 14 and the shackle is labelled 16. The shackle includes a bight portion connecting two shackle legs **16*a* and 16*b*. A key slot (not shown) in the bottom end of the padlock body receives a key which can be turned to release a free end (not shown) of the shackle leg 16*b* from locked engagement with a lock mechanism within the body 14. The illustrated padlock is a key operated padlock and the illustrated padlock case 12** is particularly designed for use in combination with this padlock. Similarly, a combination type padlock, having a combination dial, can be protected by following the principles of the invention by a case particularly designed for use in combination with the padlock.

The case 12 surrounds the padlock body portion 14 which is contained, or nested, therein and thereby protected by the case against direct exposure to mud, water, or other harmful elements of an outdoors environment.

The case 12 is comprised of a case container 20 and a case cover 22 which mate with each other to define an enclosed space therein which is adapted to receive the body portion 14 of a padlock 10 in the manner shown in FIG. 1. The space defined by the case is slightly greater in volume than the volume occupied in the case by the padlock body 14.

The case container 20 includes a bottom wall **20*a*, a front wall 20*a*, a back wall 20*c*, and side walls 20*d* and 20*e***. The upper end of the container is open so that a padlock body can be placed into the container.

The container bottom wall **20*a* includes four recesses 24 provided to receive respective rivet ends 26 protruding from the bottom end of the padlock body near its lowermost corners. Two tiny bumps, or bosses 28*a* and 28*b*, protrude from the side walls 20*d* and 20*e* near the bottom wall 20*a* to locate the padlock body in the center of the container. In this case, it can be observed that the container 20 is slightly wider than the width of the padlock body, as indicated in FIG. 2, with the sides of the padlock body pressed between the bumps 28*a* and 28*b* which are somewhat resilient. Two elongated and narrow lips 30*a* and 30*b* are formed on the inside of the upper edges of the container front wall 20*b* and the container back wall 20*c*. Each of these lips 30*a* and 30*b* extends sidewardly a slight distance toward the center of the container to hang over the inside surfaces of the front and back walls. The width of the gap between these lips is slightly less than the thickness of the padlock body 14. The width of the gap between the front and back container walls is slightly greater than the thickness of the padlock body 14.**

The container lips 30*a* and 30*b* cooperate to lightly, but firmly, embrace the upper portion of the padlock body to hold the container on the padlock body and thereby keep the container from falling away from the padlock body. A narrow rim flange extends around the upper end of the container and fits in the case cover 22, in the manner as illustrated in FIG. 2, to provide a more effective seal between the container and the cover and to provide a tighter fit between the container and the cover.

The case cover 22 includes a top wall 22*a* and a cover flange defined by a front wall 22*b*, a back wall 22*c*, and side walls 22*d* and 22*e*. The cover 22 mates with the container so that the cover flange overlaps with the upper end of the container 20 and which upper end fits snugly into the cover flange.

Figure 7:
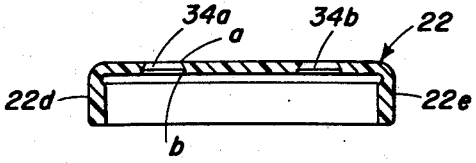
FIG. 7 is a fragmentary vertical sectional view taken on line 7—7 of FIG. 6.

The cover 22 includes two bevelled, round holes 34*a*, 34*b* located in the middle of the cover top wall 22*a* and having a center to center spacing equal to the spacing between the centers of the legs 16*a* and 16*b* of the shackle 16 forming part of the padlock 10. Each cover hole 34*a* and 34*b* is bevelled to have a conical configuration, as shown in FIG. 7, to form a small diameter edge "*a*" at the top side of the cover wall 22*a* and *a* large diameter edge "*b*" at the bottom side of the cover top wall 22*a*, and which diameter edge "*b*" is of slightly larger diameter than the edge "*a*" and "*b*" of both cover holes are of equal diameter. The diameter of the edge "*a*" of each hole is slightly less than the diameter of the shackle legs 16*a* and 16*b* and which shackle legs 16*a* and 16*b* are of the same diameter. The diameter "*b*" of each cover hole is slightly greater than the diameter of the shackle legs 16*a* and 16*b*. The shackle legs 16*a* and 16*b* are received in the cover holes in a close fit with the legs acting to cause resilient enlargement of the hole edges "*a*". The shackle legs 16*a* and 16*b* seal the cover holes with the hole edges "*a*" resiliently embracing the shackle legs to keep water from getting into the case through the openings provided by the cover holes. The cover holes serve as aperture means through which the shackle legs project from the padlock body 14 to the outside of the case.

The bottom side of the cover wall 22*a* includes two rectangular recesses wherein the cover holes 34*a* and 34*b* are located. Some padlocks have body portions with annular lips that surround the shackle legs at their point of entry into the padlock body portion. The recesses, identified as 36*a* and 36*b*, are provided to receive such annular lips when such padlock has its body portion 14 contained in the case.

The container 20 and the cover 22 are both molded plastic members and are in this instance made of polyethylene. Other suitable plastic material can be used in lieu of polyethylene. The thickness of the walls of the container 20 and of the cover 22 is such that they are not completely rigid but are instead somewhat flexible to make it easy to mate and unmate the cover 22 and the container 20 and yet obtain a close fit between the cover 22 and the container 20 when they are mated.

The case 12 surrounds the padlock body portion 14 and thereby protects it from outdoor conditions. Although the case is primarily useful for protecting a padlock during its use outdoors, it is also useful to keep the padlock body portion from scratching up other articles such as a bicycle provided with a chain and an encased padlock used to chain up the bicycle.

The padlock 10 and the case 12 are assembled as follows. First, the padlock is unlocked to disengage, or release, a free end (not shown) of the shackle leg 16*b* from the lock mechanism in the padlock body 14. Next, the container is held in one hand and the container side walls 20*d* and 20*e* are squeezed together to bow or flex these walls inwardly of the container toward each other. This action thereby will cause the container front and back walls 20*b* and 20*c* to bow outwardly of the container so that the flex away from each other to increase the width of the gap existing between the container lips 30*a* and 30*b*. The lips 30*a* and 30*b* move away from each other until the gap therebetween becomes wid enough to receive the padlock body portion 14 without any significant interference between the lips 30*a* and 30*b* and the nearby sides of the padlock.

The padlock body portion 14 is lowered through the open upper end of the container 20 and made to approach the bottom wall 20*a*. The lower edges of the sides of the padlock body 14 slip, or move, between the bumps 28*a* and 28*b* which thereupon plastically, or resiliently, deform to lightly embrace the padlock body while acting to center the padlock body inside the container so that the sides of the padlock are equally spaced from the container side walls 20*d* and 20*e*.

Next, the squeeze pressure exerted on the container side walls 20*d* and 20*e* is removed whereupon these walls return, by virtue of their inherent resiliency, to, or toward, their natural, unflexed condition and configuration. The container front and back walls thereupon resiliently return to, or toward, their natural, unflexed condition and configuration causing the container lips 30*a* and 30*b* to firmly embrace, or grip, the upper end of the padlock body, with the container lips, depending on the precise dimensions of the particular case, either (a) contacting the front and back sides of the padlock body 14 at a point slightly below the upper edges of the padlock body 14, or (b) projecting over onto the upper end of the padlock body 14. The container lips 30*a* and 30*b* act to hold the container 20 on the padlock body 14 so (a) the container 20 will not fall off of the padlock body 14, and (b) the padlock body 14 cannot be easily removed from within the container 20 without first causing the container lips 30*a* and 30*b* to separate or move away from each other so that the sides of the padlock body 14 will substantially clear the lips 30*a* and 30*b* as the padlock is withdrawn from the container Next, the cover 22 is assembled with the container 20 and the padlock 10 as follows. The free end of shackle leg 16*b* is inserted into cover hole 34*a* which fits tightly onto the shackle leg so that the edge "*a*" of the hole 34*a* wipes along the shackle leg, and the cover is moved past the bight portion of the shackle onto the shackle leg 16*a*. The cover is now pivoted about the shackle leg 16*a* and aligned with the cover 22 so that the cover flange faces toward the upper end of the container 20. The cover 22 is now pushed downward onto the upper end of the container 20 to mate the cover 22 and container 20 with the cover flange overlapping the upper end of the container flange, or lip 32 closely fitted within the cover flange to seal the cover to the container. The cover flange and also the flange 32 act to keep water out of the case.

Thereafter, the shackle is pivoted about its leg 16*a* to locate the free end of the shackle leg 16*b* over the vacant cover hole 34*b*, which is in registry with the opening of the padlock body that is adapted to receive the free end of the shackle leg 16*b*. The padlock 10 can now be locked by pushing the shackle toward the padlock body 14 to drive the free end of the shackle leg 16*b* through the cover hole 34*b* and into the padlock body 14 into locking engagement with the padlock lock mechanism. The shackle leg 16*b* seals the opening provided by the cover hole 34*b* in the manner shown in FIG. 2. Because of the close fit between the shackle legs 16*a* and 16*b* and the surrounding edges, or portions of the cover 22, water cannot get into the case via the cover holes 34*a* and 34*b*.

The case 12 can be separated from the padlock 10 in the following manner. First, the cover 22 is gripped by its cover flange and the cover 22 is lifted away from the container 20 to unmate the cover from the container. The cover is moved toward the bight portion of the shackle 16 to so locate the cover that the cover holes 34*a* and 34*b* encircle the upper ends of the shackle legs near the bight portion. Squeeze pressure is exerted on the container side walls 20*d* and 20*e* to cause them to bow inward and force the container front and back walls 20*b* and 20*c* to bow outward. In this way, the walls 20*b* and 20*c* will carry the container lips 30*a* and 30*b* substantially out of contact with the upper part of the padlock body 14 so that the effective gap between the container lips 30*a* and 30*b* widens and becomes wider than the thickness, from front to back, of the padlock body portion 14.

Next, the padlock 10 is lifted away from the container 20 to lift the padlock body portion 14 out of the container through its open upper end. The padlock can now be unlocked in the usual manner by the use of a key. After the padlock has been unlocked so that the free end of the shackle leg 16*b* is disposed outside of the padlock body, it is possible to remove the case cover 22 from the padlock by (a) pushing the case toward the padlock body to remove the shackle leg 16*b* from the cover hole 34*b*, and (b) slipping the cover along the shackle leg 16*a*, the shackle bight portion, and the leg 16*b* until the free end of the leg 16*b* is removed from within the cover 34*a*.

Although the best mode contemplated for carrying out the present invention has been herein shown and described, it will be apparent that modifications and variations may be made without departing from what is regarded to be the subject matter of the invention.

Having thus described my invention, what I desire to claim and secure by letters patent is:

1. A case for containing and surrounding the body portion of a padlock to protect such body portion from deleterious substances, said case comprising, in combination, a case container having a plurality of walls forming an enclosing side wall member and at least one open end at one end of said side wall member, a case cover that mates with the open end of the container to form said case, opening defining means in said case and being sized and located for receiving the legs of of a padlock shackle whereby the body portion of a padlock can be contained within the case with the shackle protruding through the opening defining means in the case to the outside of the case, said case container and case cover substantially conforming in size and shape to the body portion of a padlock, and substantially enclosing the body portion of the padlock to be contained within the case, and lip means on at least one wall of said container for gripping a corresponding side of a padlock body portion.

2. The case set forth in claim 1 further characterized in that said case container includes flexible but relatively non-stretchable walls.

3. The case set forth in claim 1 further characterized in that said case container includes means adapted to center a padlock body portion within said case container.

4. The case set forth in claim 1 further characterized in that said case container has an open upper end and includes a container flange on its upper end, said case cover also including a cover flange located so that said container flange is adapted to fit tightly into engagement with said cover flange.

5. The case set forth in claim 1 further characterized in that the opening defining means is comprised of two round holes and each being sized to form a tight fit with a respective shackle leg of a padlock shackle.

6. The case set forth in claim 1 further characterized in that said case cover and and case container are comprised of plastic material formed to define flexible walls in each of said case cover and case container.

7. The case set forth in claim 1 further characterized in that said plurality of walls comprises a pair of opposed spaced apart walls, and said lip means comprises an individual lip on each of said opposed spaced apart walls which are sized and located to press against opposed portions of a padlock body portion to hold the padlock body portion snugly within the case container.

8. A case for containing and surrounding the body portion of a padlock to protect such body portion from deleterious substances, said case comprising, in combination, a case container having a plurality of side walls forming an enclosing side wall member and at least one open end at one of said side wall member, a case cover that mates with the open end of the container to form said case, opening defining means in said case and being sized and located for receiving the legs of a padlock whereby the body portion of a padlock can be contained within the case with the shackle protruding through the opening defining means in the case to the outside of the case, said container having an enclosing end wall which is substantially perpendicularly located with respect to said plurality of side walls, said case container and case cover substantially conforming in size and shape to the body portion of a padlock and substantially enclosing the body portion of a padlock to be contained within the case, and means on said enclosing wall to center a padlock body portion within said case container.

9. The case set forth in claim 8 further characterized in that said case container includes flexible but relatively non-stretchable side walls.

10. The case set forth in claim 8 further characterized in that said case container has an open upper end and includes a container flange on its upper end, said case cover also including a cover flange located so that said container flange is adapted to fit tightly into engagement with said cover flange.

11. The case set forth in claim 1 further characterized in that the opening defining means is comprised of two round holes and each being sized to form a tight fit with a respective shackle leg of a padlock shackle.

12. The case set forth in claim 8 further characterized in that said case members are comprised of plastic material formed to define flexible side walls in each of said case members.

13. The case set forth in claim 8 further characterized in that lip means is provided on at least one of said plurality of side walls of said container for gripping a corresponding side of a padlock body portion.

14. The case set forth in claim 8 further characterized in that the opening defining means is comprised of two round beveled holes each sized to form a snug fit with a respective shackle leg whereby a body portion of a padlock can be contained within the case with the padlock's shackle protruding through the case to the outside of the case.

15. A method for protecting a padlock having a body portion and a shackle extending from the body portion, said method comprising inserting the body portion in a container through an open end thereof and which container is provided with a plurality of side walls forming an enclosing side wall member sized and shaped to retain and substantially enclose the body portion, placing a cover member over the open end of said container to form a case and to thereby enclose the body portion, inserting the legs of said shackle through a pair of apertures in said body portion and which apertures are sized to form a snug fitting engagement with the legs of said shackle.

16. The method of claim 15 further characterized in that the method comprises centering the padlock body portion in the container of the case.

17. The method of claim 15 further characterized in that the method comprises gripping a sidewall of a body portion of a padlock to retentively retain same in the container of the case.

18. A case for containing and surrounding at least a portion of the body section of a padlock to protect the interior thereof from a deleterious environment, said case comprising a first case container section having a first continuous side wall comprised of a plurality of first side wall sections and a bottom wall extending across and connecting said first side wall sections, said first container section being sized and shaped so that said first side wall extends around and encloses a portion of said body section of the padlock and said bottom wall extends over a base wall of the padlock body section, said case comprising a second case container section having a second continuous side wall comprised of a plurality of second side wall sections and a top wall extending across and connecting said second side wall sections, said second container section being sized and shaped so that said second side wall section extends over a portion of the body section of the padlock and said top wall extends over a top wall of a body section of the padlock, opening defining means in said top wall and being sized and located for receiving the legs of a padlock shackle protruding through the opening defining means to the outside of the case, and means operatively associated with said bottom wall to aid in centering the padlock body section within the case.

19. The case set forth in claim 18 further characterized in that the means operatively associated with said bottom wall of said first container section comprises at least in part a plurality of spaced apart recesses in said bottom wall to receive fastener ends in said padlock body section.

20. The case set forth in claim 19 further characterized in that said bottom wall of said case snugly engages the base wall of said padlock body section when in said first container section.

21. The case set forth in claim 18 further characterized in that said case container includes flexible but relatively non-stretchable side walls.

22. The case set forth in claim 18 further characterized in that the opening defining means is comprised of two round holes and each being sized to form a tight fit with a respective shackle leg of a padlock shackle.

23. The case set forth in claim 18 further characterized in that lip means is provided on at least one of said plurality of first side wall sections of said container for gripping a corresponding side of a padlock body portion.

24. The case set forth in claim 18 further characterized in that the opening defining means is comprised ot two round beveled holes each sized to form a snug fit with aa respective shackle leg whereby a body portion of a padlock can be contained within the case with the padlock's shackle protruding through the case to the outside of the case.

25. The case set forth in claim 18 further characterized in that the means operatively associated with said bottom wall at least in part comprises a pair of spaced apart bosses which engage said padlock body section.

26. The case set forth in claim 18 further characterized in that lip means is located on at least one of said first side wall sections for gripping a correspponding side of the padlock body section.

27. The case set forth in claim 18 further characterized in that said plurality of first side wall sections comprises a pair of opposed spaced apart walls, and an individual lip on each on said opposed spaced apart walls which are sized and located to press against opposed portions of a padlock body portion to hold the padlock body portion snugly within the case container.

28. A case for containing and surrounding at least a portion of the body section of a padlock to protect the interior thereof from a deleterious environment, said case comprising a first case container section having a first continuous side wall comprised of a plurality of first side wall sections and a bottom wall extending across and connecting said first side wall sections, said first container section being sized and shaped so that said first side wall extends around and encloses a portion of said body section of the padlock and said bottom wall extends over a base wall of the padlock body section, said case comprising a second case container section having a second continuous side wall comprised of a plurality of second side wall sections and a top wall extending across and connecting said second side wall sections, said second container section being sized and shaped so that said second side wall section extends over a portion of the body section of the padlock and said top wall extends over a top wall of the body section of the padlock, and means forming a pair of openings in said top wall and being sized and shaped to receive the legs of a padlock shackle protruding through the openings to the outside of the case, said openings having a diametrical size spaced above the innermost surface of said top wall which is sized to snugly engage the legs of the shackle, and said openings having a diametral size at the innermost surface of said top wall which is larger than the diametral size spaced above the innermost surface of said top wall.

29. The case set forth in claim 28 further characterized in that means is operatively associated with said bottom wall to aid in centering the padlock body section within the case.

30. The case set forth in claim 28 further characterized in that a pair of spaced apart recesses are formed in said top wall and said openings are located in the region of said recesses.

* * * * *